US009102506B2

(12) United States Patent
Willim

(10) Patent No.: US 9,102,506 B2
(45) Date of Patent: Aug. 11, 2015

(54) METHOD OF ASSEMBLY OF A MOBILE CRANE, AND MOBILE CRANE

(75) Inventor: Hans-Dieter Willim, Ulm-Unterweiler (DE)

(73) Assignee: LIEBHERR-WERK EHINGEN GMBH, Ehingen (DE)

( * ) Notice: Subject to any disclaimer, the term of this patent is extended or adjusted under 35 U.S.C. 154(b) by 222 days.

(21) Appl. No.: 13/466,474

(22) Filed: May 8, 2012

(65) Prior Publication Data

US 2014/0027398 A1 Jan. 30, 2014

(30) Foreign Application Priority Data

May 9, 2011 (DE) ..... 10 2011 122 812

(51) Int. Cl.
*B66C 23/70* (2006.01)
*B66C 23/36* (2006.01)

(52) U.S. Cl.
CPC ..... *B66C 23/702* (2013.01); *B66C 23/365* (2013.01); *Y10T 29/49616* (2015.01)

(58) Field of Classification Search
USPC ..... 212/175, 177, 176, 299, 294
See application file for complete search history.

(56) References Cited

U.S. PATENT DOCUMENTS

| | | | | |
|---|---|---|---|---|
| 3,426,914 | A * | 2/1969 | Van De Hey et al. | 212/177 |
| 3,945,333 | A * | 3/1976 | Fritsch et al. | 212/177 |
| 3,968,884 | A * | 7/1976 | Johnson et al. | 212/300 |
| 4,491,229 | A * | 1/1985 | Behrendt et al. | 212/270 |
| 5,199,586 | A * | 4/1993 | Pech et al. | 212/175 |
| 5,642,821 | A * | 7/1997 | Hafliger | 212/177 |
| 6,213,318 | B1 * | 4/2001 | Walker | 212/177 |
| 6,702,132 | B1 * | 3/2004 | Moore et al. | 212/270 |
| 7,878,346 | B1 * | 2/2011 | Watts et al. | 212/168 |
| 8,534,474 | B2 * | 9/2013 | Holly et al. | 212/177 |
| 8,684,198 | B2 * | 4/2014 | Irieda et al. | 212/299 |
| 2003/0146181 | A1 * | 8/2003 | Taylor et al. | 212/299 |
| 2005/0150854 | A1 * | 7/2005 | Toudou et al. | 212/175 |
| 2009/0127219 | A1 * | 5/2009 | Willim | 212/300 |
| 2010/0243595 | A1 * | 9/2010 | Walker et al. | 212/294 |
| 2011/0233165 | A1 * | 9/2011 | Holly et al. | 212/177 |
| 2012/0067840 | A1 * | 3/2012 | Walker | 212/177 |
| 2012/0175333 | A1 * | 7/2012 | Pech et al. | 212/177 |

FOREIGN PATENT DOCUMENTS

| | | |
|---|---|---|
| DE | 98887 | 7/1973 |
| DE | 102009010452 | 9/2010 |
| EP | 593390 | 12/1994 |
| EP | 2 223 882 A2 | 9/2010 |

* cited by examiner

*Primary Examiner* — Emmanuel M Marcelo
(74) *Attorney, Agent, or Firm* — Dilworth & Barrese, LLP.

(57) ABSTRACT

Method for the assembly of a mobile crane, particularly a telescopic crane, at a construction site, having a main boom as well as at least one boom enhancement loaded on a transport in turn having at least one lattice section. The method includes the steps of moving the mobile crane and/or the transport, to coarsely align the crane main boom and at least one lattice section of the boom enhancement to each other, connecting the crane main boom to the lattice section by one or more traction elements, and raising the main boom, which results in traction being applied to the one or more traction elements, to align the axes of the junctions of the main boom and of the lattice section at least partially for the subsequent assembly.

22 Claims, 4 Drawing Sheets

METHOD OF ASSEMBLY OF A MOBILE CRANE, AND MOBILE CRANE

BACKGROUND OF THE INVENTION

The invention relates to a method for assembling a mobile crane, particularly a telescopic crane, at a construction site, having a main boom as well as at least one boom enhancement.

Large telescopic cranes frequently use lattice sections as main boom extension during the use of the crane. In the same way, lattice sections are routinely assembled to a luffing or fixed fly boom, and an assembled to the telescopic main boom of the telescopic crane.

Due to the vehicle dimension of the mobile crane that is allowed in road traffic, the individual lattice sections are transported separately to the site of deployment, and assembled on the crane boom only after their arrival at the construction site. However, auxiliary material, such as, for example, an auxiliary crane, are absolutely required for the assembly of the different lattice elements at the construction site. An optimal use of the transport volume of the lattice sections is usually ensured by appropriate transport systems which enable the combined transport of the heavy ballast pieces with the individual lattice sections.

The transport of an auxiliary crane to the site of deployment always entails considerable costs, because this crane can be used only unsatisfactorily or not at all for other crane work at the construction site. Furthermore, in some cases the use of the auxiliary crane is ruled out, due to spatial constraints at the construction site.

SUMMARY OF THE INVENTION

The problem of the present invention now consists in providing a method for assembling a crane at the site of deployment, which is not only more cost effective, but at the same time simpler and less time consuming.

The posed problem is solved by a method for assembling a mobile crane, which comprises the characteristics herein. The method concerns, in detail, the assembly of a boom extension, which consists of at least one lattice section, on the main boom of the mobile crane, which is designed particularly as a mobile telescopic crane.

The method according to the invention thus proposes to coarsely align the main boom and at least one lattice section of the boom enhancement by moving the means of transport or the mobile crane, and bringing them into the assembly position. Subsequently, the main boom and the lattice section are connected to each other by one or more traction means. The one or more traction means are then subjected to certain traction by raising the main boom. Advantageously, this results in the raising of the boom enhancement to be mounted from the loading surface of the means of transport, and the axes of the junctions of the lattice sections or of the boom enhancement are also aligned horizontally. Accordingly, the axes of the junctions of the main boom, as well as those of the boom enhancement are at least partially aligned parallel to each other and horizontally, which allows the pairing, particularly the bolting of the junctions. The raising of the main boom occurs, for example, by means of the luffing drive, particularly the luffing cylinder.

At least one boom enhancement can be a main boom extension, or a luffing or fixed fly boom. The boom enhancement can preferably consist of several lattice sections which are assembled successively on the main boom.

A considerable time saving in the crane assembly can be achieved, if the lattice sections are not moved individually to the construction site, and, instead, are assembled already before the transport by preassembly to form at least one boom enhancement. Accordingly, the boom enhancements are preassembled in a ready-for-use state, i.e., they are preferably put beforehand in a largely functioning state. For the assembly of a boom enhancement, the method according to the invention accordingly has to be designed only one time for the attachment of the end-side lattice section of the boom enhancement which is preassembled from several lattice sections.

At least one preassembled boom enhancement is transported separately from the mobile crane using a means of transport to the site of deployment. The means of transport for the at least one boom enhancement is preferably a semitrailer or a flat-bed trailer.

One or more preassembled boom enhancements are secured on the means of transport, preferably by a suitable device of the means of transport, in a position that is suitable for the transport and for the subsequent assembly on the mobile crane.

For example, when planning the use of the mobile crane, the required boom enhancement is determined. The corresponding boom combination is disassembled into individual boom enhancements which are moved by means of the transport vehicle to the site of deployment. The corresponding boom combination is then achieved by the successive assembly of the individual boom enhancements on the mobile crane. Naturally, the complete boom combination can be transported in an already preassembled state to the construction site, and assembled as a whole on the mobile crane, in a single assembly process.

The method according to the invention opens a possibility for the mobile crane to undergo self assembly of at least one lattice section or one boom enhancement on its main boom. A cost-intensive auxiliary crane is accordingly no longer needed. The self assembly of the boom enhancement is made possible by the use according to the invention of the traction means. For the self assembly, the mobile crane is already connected to its required ballast as well as to its main boom.

For the self-assembly of the lattice section or of the boom enhancement, i.e., for the installation of the traction means, the mobile crane is brought into the assembly position. Advantageously, the main boom of the mobile crane is lowered by means of the luffing cylinder into an approximately horizontal position, in order to move the junctions of the main boom into the area of the junctions of the lattice section loaded on the means of transport or the area of the boom enhancement, in order to be able to establish the connection by means of one or more traction means.

In particular, the telescoping cylinder of the main boom is moved for this purpose as much as permissible to a stop position, in order to reach the optimal assembly position for the establishment of a connection between lattice section/boom enhancement and the main boom. Here, it is possible to use a head-side inclination of the main boom by approximately 1° or more with respect to the horizontal. The inclination has the effect that the junctions of the main boom, which are arranged on the side of the head, are located beneath the junctions of the boom enhancement, which simplifies the subsequent connection process.

Based on the technical conditions of known luffing drives, an inclination of the longitudinal axis of the main boom is limited to from approximately 1° to a maximum of 2° under the horizontal. If the possible angle of inclination of the luffing drive is insufficient for the assembly process, then, in a preferred embodiment, the inclination of the main boom can be increased by adjusting the adjustable axle suspension and/or the crane support Of the mobile crane. As a result, an additional, head-side inclination of the main boom longitudinal axis with respect to the horizontal of approximately 1° or more can be achieved.

In a preferred embodiment of the method according to the invention, the adjustable axle suspension is here first lowered almost completely, resulting in an overall very low and consequently easily accessible working height for the subsequent connection process between the boom enhancement and the main boom. The crane-dependent required inclination of the main boom longitudinal axis is adjusted subsequently by means of the crane support. An alignment of the main boom longitudinal axis that is at an inclination with respect to the horizontal, with a horizontally aligned main boom transverse axis is advantageous.

Optionally, the longitudinal axes of the main boom and of the lattice section/boom enhancement can be placed into a common vertical plane by rotating the crane upper carriage.

Furthermore, it is advantageous if the longitudinal axes of the main boom and of the lattice section are aligned in mutual alignment by moving the means of transport and/or the mobile crane. By telescoping the main boom or moving the means of transport and/or mobile crane, a covering of the junctions of the main boom and the lattice section is then achieved. In this case, the upper ends of the tensioned traction means move on circular tracks. Subsequently, the connection means, particularly the connecting bolls, can be inserted.

The length of the traction means is adapted especially to the lattice section geometry. Advantageously, the elongation of the one or more traction means is adapted accordingly prior to the raising process, to ensure an optimal alignment of the connecting axes.

Moreover, the connecting line of at least one traction means extends preferably from the main boom area lying in the horizontal position at the top to the area of the boom enhancement, which lies at the bottom. The attachment points of the traction means on the boom enhancement or on the main boom are located in the proximity of the respective junctions or bolting places, the access to the latter being however not affected by the traction means.

By carrying out the method repeatedly, a boom enhancement which is preferably already mounted on the main boom can advantageously be installed with at least one additional boom enhancement. The above description in this case relates to the junctions of the boom enhancement which is already assembled on the main boom as well as to the junctions of the boom enhancement to be installed, which is loaded on the loading surface of the means of transport.

The disassembly of the mobile crane occurs advantageously by reversing the sequence of carrying out the steps of the method.

The invention further relates to a mobile crane having a main boom and at least one boom enhancement consisting of at least one lattice section. The invention relates particularly to a mobile crane having a telescopic boom. According to the invention, the mobile crane is designed with appropriate means to carry out the method according to the invention. The mobile crane consequently presents the same advantages and details as the above described advantageous embodiments of the method according to the invention, and therefore no new explanation is given here.

A possible embodiment of the mobile crane provides that at least one traction means is a rope, or chain, or a hinged tube. In the same way, the combination of the proposed elements to form a traction means is conceivable. It is also conceivable to link individual elements to each other, one after the other and/or parallel to each other, to form a traction means. Accordingly, a traction means can be connected via one or more attachment points to the main boom and/or to the boom enhancement.

Preferably at least one traction means is designed so its length is adjustable, to ensure an optimal adaptation to the employed lattice section geometry of the boom enhancement as well as of the main boom of the mobile crane.

At least one boom enhancement is a main boom extension or a luffing or fixed fly boom. A boom combination made of the enumerated boom enhancements is also possible.

BRIEF DESCRIPTION OF THE DRAWINGS

Additional details and advantages of the invention are explained in further detail below in reference to an embodiment example represented in the figures. The figures show.

DESCRIPTION OF THE PREFERRED EMBODIMENTS

In the subsequent portion of the description, a concrete embodiment example of the method according to the invention for the assembly of a telescopic crane and an embodiment example of the telescopic crane are described in reference to FIGS. 1-6.

When planning the use of a crane, the required boom combination is established for a telescopic mobile crane. To enhance the crane main boom, one or more boom enhancements are to be assembled on the main boom point, to equip the crane for the planned crane work. The corresponding boom enhancements consist of individual lattice sections 1, 1*a*, 1*b*, 1*c*, 1', 1*a'*, 1*b'*, 1*c'* which are already combined with each other prior to the transport to the site of deployment, and which were put in a largely functioning state. Possible preassembled boom enhancements are, for example, a main boom extension or also a fixed or a luffing fly boom.

Figure 1:
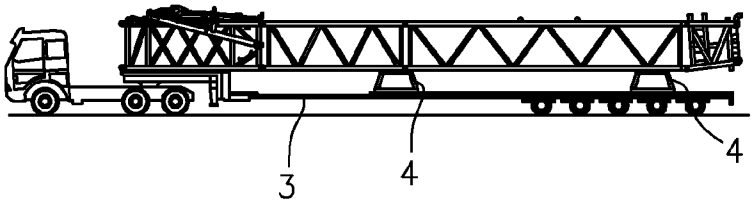
FIG. 1: a side view of the means of transport for a boom enhancement.

The complete boom combination, disassembled into individual boom enhancements 2, 2', is loaded at the central facility from a crane located there on the transport vehicle 3 represented in FIG. 1, and moved to the construction site. The individual boom enhancements 2, 2' are attached by appropriate devices 4 on the loading surface of the transport vehicle 3 in a position that is suitable for the transport and the subsequent assembly process.

Figure 2:
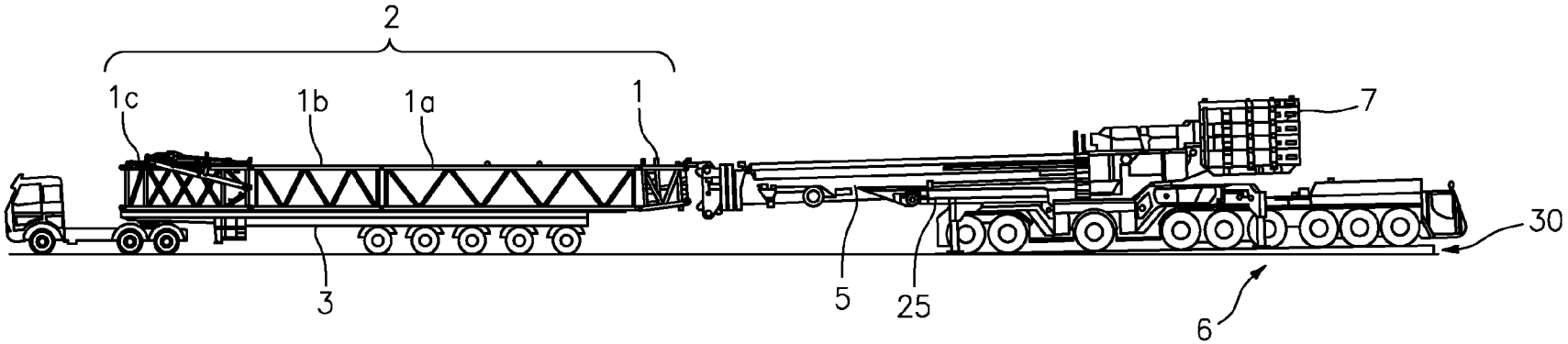
FIG. 2: a side view of the mobile crane according to the invention in the assembly position.

The mobile crane 6, which moves independently to the construction site, is already connected to the ready-for-use main boom 5 as well as to the ballast 7 required for the crane work. For the assembly of the boom enhancement 2, 2', the crane 6 is brought into the fitting assembly position. For this purpose, the main boom 5, as shown in FIG. 2, is lowered by means of the luffing cylinder 25 into the horizontal, and moved as much as permitted to a slop. The transport vehicle 3 on which the main boom extension 2 has been loaded is then positioned in such a manner with respect to the mobile crane that the extension 2 as well as the main boom 5 lie on a common axis, and the bolting places required to establish the connection are brought close to each other.

For the pairing of the corresponding bolting places, it is necessary that the bolting places of the main boom 5, in the assembly position, are located slightly beneath the bolting places of the boom extension 2 to be mounted. This prerequisite requires a slanted position of the main boom 5, which is achieved by adjusting the main boom longitudinal axis on the side of the head by approximately 1° below the horizontal. As a rule, such an inclination is already achieved by the maximum possible lowering of the main boom to a stop. The usual luffing units here achieve a slanted position of the main boom 5 by approximately 1 to a maximum of 2° with respect to the horizontal.

If the inclination angle achieved thereby is insufficient for the assembly conditions, then the inclination can be further increased by a targeted control of the axle suspension and optionally the crane support 27. The mobile crane 6 is first lowered by means of the adjustable axle suspension, to allow as low as possible a working height. Subsequently, the mobile crane 6 is braced by means of its support 27. In particular, the front pair 27*a* of the support 27 is deployed further compared to the rear pair 27*b*, in order to adjust the desired inclination of the mobile crane 6 or of the main boom longitudinal extension by the angle 30. This allows an additional inclination of the crane by approximately 1° with respect to the horizontal. It should be noted here, that the corresponding pairs 27*a*, 27*b* of the crane support 27 are deployed in such a manner so as to align the crane transverse axis horizontally. In the process, any uneven places of the ground must be taken into account. The final connection between the main boom 5 and the boom extension 2 is explained in further detail in the corresponding description section for FIG. 4.

Figure 3:
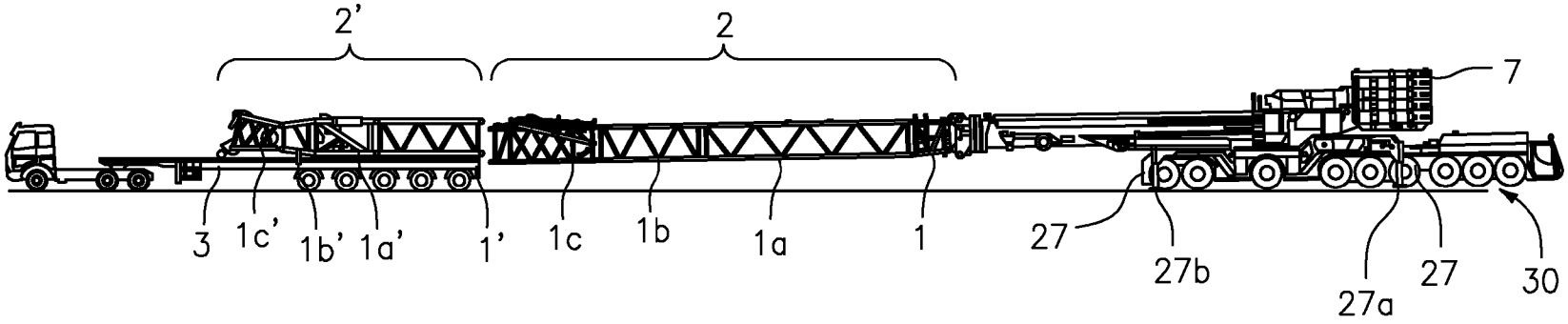
FIG. 3: an additional side view of the mobile crane according to the invention.

FIG. 3 shows the mobile crane with the boom extension 2 already mounted on the main boom 5, in the assembly position for receiving the luffing fly boom 2' loaded on the transport vehicle 3, the latter boom having already been assembled before the transport from the lattice sections 1', 1*a*', 1*b*', 1*c*'. In the assembly position, the boom combination consisting of the main boom 5 and the boom extension 2 is lowered into the horizontal, as described above. Moreover, the mobile crane 6 and the transport vehicle 3 are positioned in such a manner that the longitudinal axes of the fly boom 2' and of the already assembled boom combination lie on a common axis, and the junctions are brought close to each other. The slanted position of the mobile crane 6 has the effect that the junctions 20, 20', 21, 21' of the boom extension 2 lie beneath the junctions 22, 22',23, 23' of the fly boom 2'.

Figure 4:
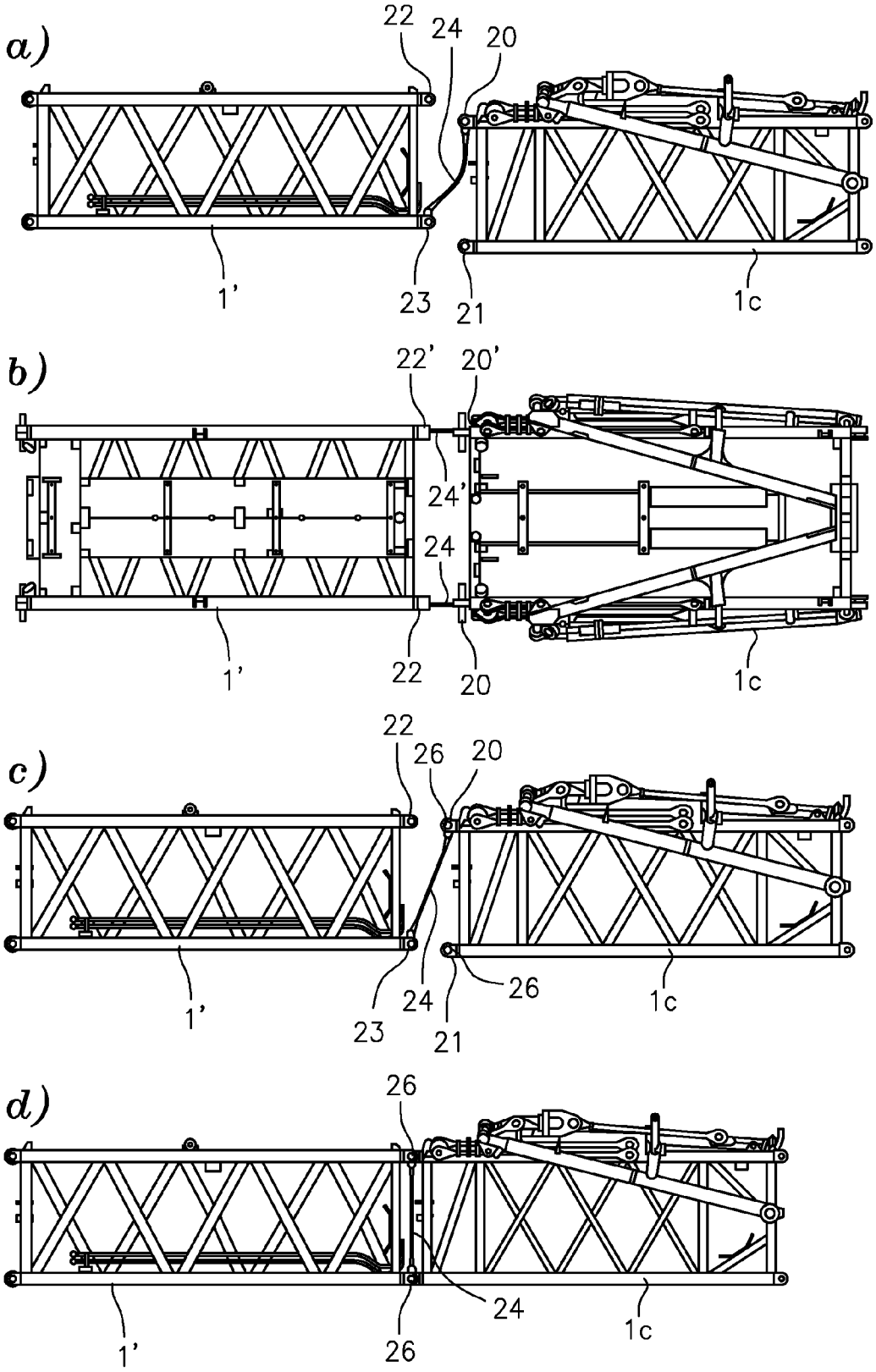
FIG. 4: several detail views of the connecting area between two boom enhancements.

Several detail views of the lattice sections 1', 1*c* of the boom extension 2 and of the fly boom 2', which sections comprise the respective bolting places 20, 20', 21, 21', 22, 22', 23, 23', can be seen in the individual drawings of FIG. 4, wherein the mobile crane assumes the assembly position shown in FIG. 3. FIG. 4*a* shows the Iwo lattice sections 1', 1*c* in a side view, wherein the junctions 20, 20', 21, 21' of the boom extension 2, clue to the position of the crane which is slanted by the angle 30, lie beneath the junctions 22, 22', 23, 23' of the fly boom 2'. In this position, the traction means 24, 24' according to the invention are connected to the lattice sections 1', 1*c*. The respective attachment points of the traction means 24, 24' lie in the proximity of the bolting places 20, 20' as well as 23, 23'. and they extend consequently at a slant from the area of the lattice section 1*c*, which is located at the top, to the area of the lattice section 1', which is located at the bottom. The access to the bolting places 20, 20', 23, 23' remains unaffected by the attachment of the traction means 24, 24'.

The length of the traction means 24, 24' is adapted especially to the lattice section geometry; however, if needed, said length can be adjusted by means of a provided adjustment mechanism. Thus, on the one hand, the work length can be adjusted for the first time, and, on the other hand, a certain elongation during the crane operation can be compensated. FIG. 4*b* shows a top view of the relevant end-side lattice sections 1', 1*c* of the boom extension 2 and of the fly boom 2'. In particular, FIG. 4*b* shows the parallel course of the two traction means 24, 24' from the top side of the boom extension lattice section c to the bottom side of the fly boom lattice section 1'.

After the lattice sections have been connected by means of the traction means 24, 24', the main boom 5 is raised slightly by means of the luffing cylinder 25, to generate tension in the traction means 24, 24' (side view FIG. 4*c*). Subsequently, the upper carriage is also rotated, in order to place the longitudinal axes of the main boom 5 and of the boom extension 2 in a vertical plane.

Ideally, the main boom is erected until the fly boom 2' is raised from the loading surface of the transport vehicle 3, and its transverse axis is aligned completely horizontally. In this case, the bolt axis of the bolting places 22, 22', 23, 23' also extends horizontally. Since the transverse axis of the main boom 5 or of the boom extension 2 has already been aligned horizontally by means of the support 27, all the bolt axes of the junctions 20, 20', 21, 21', 22, 22', 23, 23' consequently extend parallel to each other and horizontally.

Subsequently, the boom enhancements 2, 2' to be connected are moved towards each other, until the bolting places 20, 20', 21, 2'1' are paired with the bolting places 22, 22', 23, 23', and the bolts 26, which were taken from the transport position, can be inserted (side view FIG. 4*d*). Since the fly boom 2' has been raised sufficiently, the circle radius described has no effect along the traction means 24, 24'. The converging movement can be produced both by the telescoping cylinder of the main boom 5 and also by moving the transport vehicle 3 or the mobile crane 6. To finish, the main boom 5 is raised with the mounted boom enhancements 2, 2', and the transport vehicle 3 is moved out of the hazardous area.

The individual drawings a)-d) of FIG. 4 show the chronological method steps for establishing the connection between the boom extension 2 and the fly boom 2'. The described process steps can be used analogously to the assembly of the boom extension 2 on the main boom 5, starting from the assembly position of FIG. 2. The fundamental idea of the invention can also be used without problem for the mutual assembly of any boom combinations.

Figure 5:
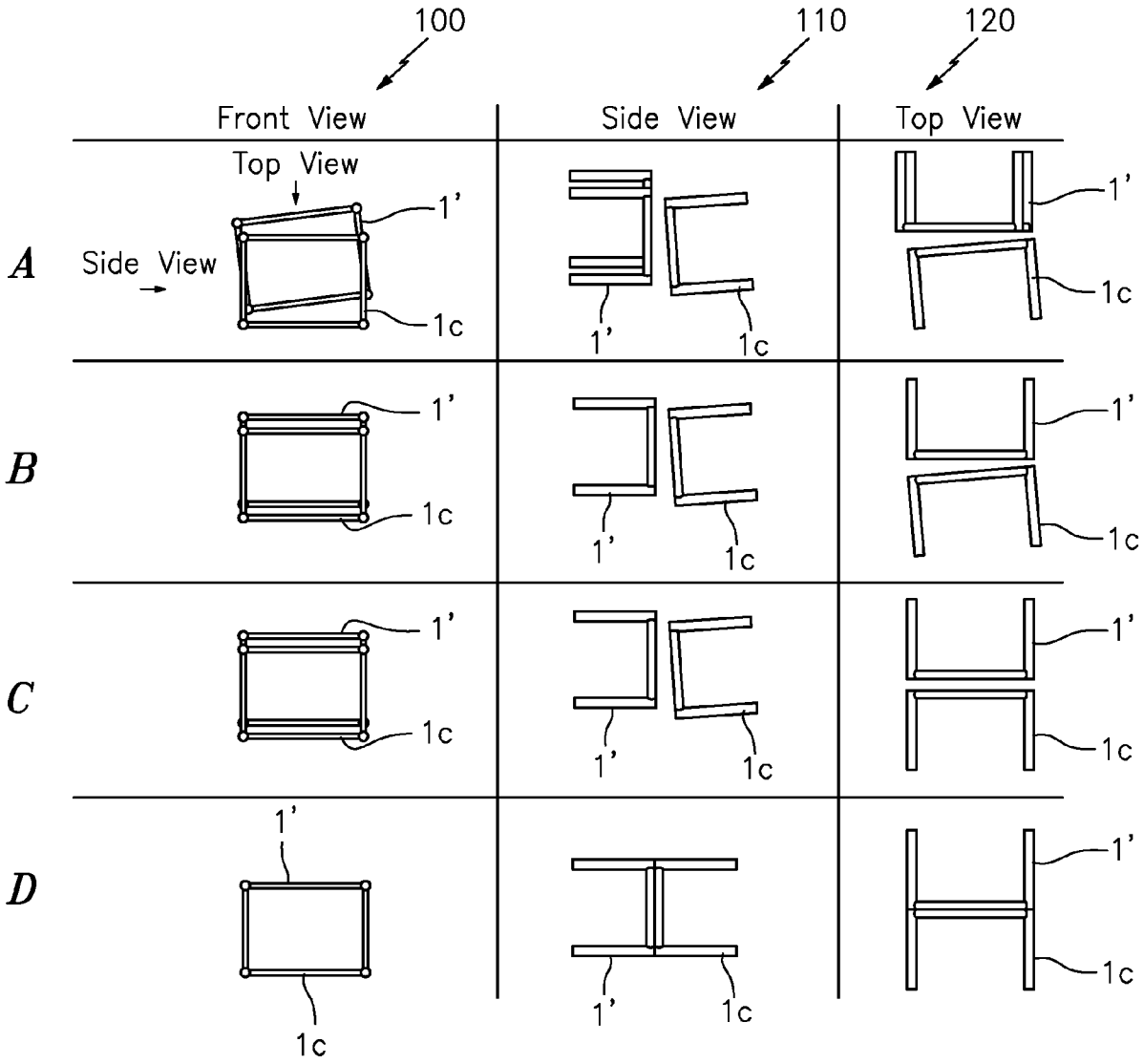
FIG. 5: a diagrammatic representation of the work steps of the method according to the invention in chronological sequence.

FIG. 5 shows the chronological sequence of the individual process steps A, B, C, and D. For each process step, the interface between the lattice section 1*c* of the boom extension 2 and the lattice section 1' of the fly boom 2' to be mounted is sketched in columns 100, 110, 120 in each case in a front, side and top view. Based on the sketches, the individual method steps are described again below.

In the first process step A, by moving the mobile crane or the means of transport 3, the two lattice sections 1*c*, 1' are coarsely aligned with each other, i.e., the main boom is lowered, and as a result inclined by a defined angle below the horizontal. In this position, the traction means can be attached. The two lattice sections 1*c*, 1' assume the position sketched in row A, columns 100, 110, 120. In FIG. 5 it can be seen that the lattice section is in a position rotated about its longitudinal axis toward the lattice section 1*c*.

The twisted position of the lattice section 1' about its longitudinal axis is remedied by raising the main boom. The traction means, which are pot under tension, have the effect that the lattice section 1' becomes aligned with respect to the lattice section 1*c*, and the connecting axes are also aligned horizontally, as can be seen in the views of row B.

By rotating the crane upper carriage, the two longitudinal axes of the lattice supports 1*c*, 1' can be aligned, so that they fall into a common vertical plane, as shown in the drawings of row C. Starting from this state, the lattice sections 1*c*, 1' can be brought by telescoping of the main boom into a position with mutually aligned longitudinal axis. Furthermore, a covering of the bolting places is achieved, so that the connecting bolts can be inserted (row D).

The disassembly of the boom enhancements 2, 2' occurs by reversing the above described method steps. The essential advantage of the method according to the invention or of the mobile crane 6 is justified in that the effort required to establish the work and transport state of the crane 6 has been reduced significantly. In particular, the time required for the fitting process can be shortened, which has a particularly positive effect on the operating costs incurred. The assembled and functioning boom extension 2, 2' can be transported immediately after the use of the crane to the next site of deployment, and be used there on the next mobile crane. Naturally, the traction means 24, 24' can also be used to mutually connect several different boom enhancements, after the latter have been separated from the connection that was established first.

Figure 6:
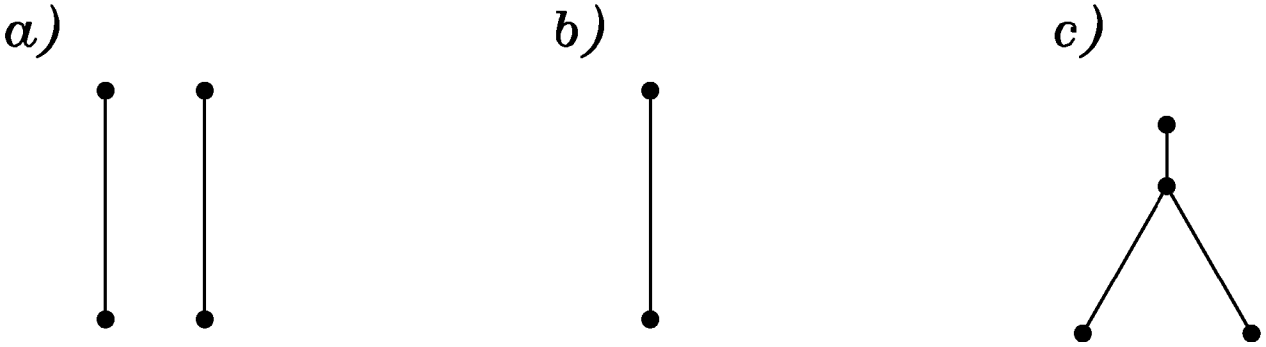
FIG. 6: a sketched representation of possible embodiments of the traction means.

Possible embodiments of the traction means 24, 24' are sketched in FIG. 6. The sketch 6*a* shows the traction means 24, 24' which extend in parallel, as they were used in the concrete embodiment example of FIGS. 1-5, and described in detail.

As an alternative, one can use an individual traction means 34 (FIG. 6*b*) or a Y-shaped traction means 44 (FIG. 6*c*) which is connected only to a lattice section 1*c*, 1' via two attachment points.

The individual traction means 24, 24', 34, 44 consist of one or more ropes, chains or hinged tubes, which are optionally designed so their length is adjustable. Under some circumstances, an individual traction means 24, 24', 34, 44 can also consist of a linked combination of one or more ropes, chains or hinged tubes.

The invention claimed is:

1. Method for assembling a mobile crane at a construction site, the crane having a main boom as well as at least one boom enhancement loaded on a transport and comprising at least one lattice section, comprising the steps of:

moving at least one of the mobile crane and the transport to coarsely align the crane main boom and the at least one lattice section of the boom enhancement to each other, connecting the crane main boom to the at least one lattice section by at least one traction means, raising of the main boom, resulting in application of traction to the at least one traction means, to align axes of junctions of the main boom and the at least one lattice section at least partially for the subsequent assembly, and pairing the junctions of the main boom and the at least one lattice section.

2. Method according to claim 1, wherein the main boom is lowered by a luffing cylinder for the attachment of the at least one traction means, and the longitudinal axis of the main boom is luffed below the horizontal.

3. Method according to claim 2, wherein an inclination of the main boom with respect to the horizontal is achieved by adjusting at least one of an adjustable axle suspension and a crane support.

4. Method according to claim 3, wherein the mobile crane is first lowered completely by the adjustable axle suspension, and the desired inclination of the longitudinal axis is adjusted by the crane support.

5. Method according to claim 3, wherein at least one of the adjustable axle extension and the crane support is adjusted by approximately 1°.

6. Method according to claim 2, wherein the longitudinal axis of the main boom is flitted by approximately 1° to 2° below the horizontal.

7. Method according to claim 1, wherein the longitudinal axes of the main boom and the at least one lattice section are placed on a common vertical plane by rotating an upper carriage.

8. Method according to claim 1, wherein the longitudinal axes of the main boom and the at least one lattice section are aligned in mutual alignment by moving at least one of the transport and mobile crane or by telescoping the main boom.

9. Method according to claim 1, wherein the at least one boom enhancement is preassembled from several lattice supports, and transported by the transport to the construction site.

10. Method according to claim 1, wherein the at least one traction means are elongated prior to raising.

11. Method according to claim 1, wherein a connecting line of the at least one traction means extends from a main boom area lying at a top in a horizontal position to an area of the at least one lattice section of the boom extension which lies at a bottom thereof.

12. Method according to claim 1, wherein the disassembly of the mobile crane occurs by reversing the method steps.

13. Method according to claim 1, wherein a boom enlargement that is already assembled on the main boom is installed with at least one additional boom enhancement by carrying out the method again.

14. Mobile crane having a main boom and at least one boom extension suitable for carrying out the method according to claim 1.

15. Mobile crane according to claim 14, wherein the at least one traction means is a rope or a chain or a hinged tube or a combination thereof.

16. Mobile crane according to claim 14, wherein the at least one traction means is adjustable in length.

17. Mobile crane according to claim 14, wherein the at least one boom enhancement is a main boom extension, or a luffing or fixed fly boom, or a combination of several boom enhancements.

18. Crane according to claim 14, wherein the crane main boom and the at least one lattice section each comprise four junctions (20, 20', 21, 21'; 22, 22', 23, 23') arranged to be coupled to one another by bolting, and the traction means (24, 24') connect laterally opposite junctions (20, 20', 21, 21'; 22, 22', 23, 23') of the crane main boom and the at least one lattice section to one another on opposite sides of an axis of the main boom.

19. Crane according to claim 14, wherein the at least one traction means are Y-shaped.

20. Method according to claim 1, wherein the at least one traction means directly interconnect the crane main boom to the at least one lattice section at the junctions thereof.

21. Method according to claim 1, wherein the crane main boom and the at least one lattice section each comprise four junctions (20, 20', 21, 21'; 22, 22', 23, 23') arranged to be coupled to one another by bolting, and the traction means (24, 24') connect laterally opposite junctions (20, 20', 21, 21'; 22, 22', 23, 23') of the crane main boom and the at least one lattice section to one another on opposite sides of an axis of the main boom.

22. Method according to claim 1, comprising the steps of lowering the main boom to incline below horizontal, attaching the traction means to junctions located on vertically opposite junctions of the main boom and the at least one lattice section, then raising the main boom to both rotate the at least one lattice section into horizontal alignment with the main boom and tension the traction means, then rotating the main boom or the at least one lattice section to vertically align the main boom and the at least one lattice section, and then bolting axially-opposite junctions of the main boom and the at least one lattice section together.

* * * * *